US005240175A

United States Patent [19]

Rutledge et al.

[11] Patent Number: 5,240,175

[45] Date of Patent: * Aug. 31, 1993

[54] CARTON DIVIDERS

[75] Inventors: Thomas S. Rutledge, Arva; William G. Atkinson, London, both of Canada

[73] Assignee: Labatt Brewing Company Limited, London, Canada

[ * ] Notice: The portion of the term of this patent subsequent to Oct. 22, 2008 has been disclaimed.

[21] Appl. No.: 780,340

[22] Filed: Oct. 21, 1991

Related U.S. Application Data

[63] Continuation-in-part of Ser. No. 663,027, Mar. 1, 1991, Pat. No. 5,058,802.

[51] Int. Cl.[5] ..... B65D 5/48

[52] U.S. Cl. ..... 229/120.26; 229/120.24; 229/120.25

[58] Field of Search ..... 229/120.14, 120.15, 229/120.16, 120.24, 120.25, 120.26, 120.27, 120.29

[56] References Cited

U.S. PATENT DOCUMENTS

| | | | |
|---|---|---|---|
| 1,115,476 | 11/1914 | Ashton | 229/120.25 |
| 2,584,967 | 2/1952 | Watson et al. | 229/120.27 |
| 2,723,796 | 11/1955 | Malmgren | 229/120.26 |
| 2,792,982 | 5/1957 | Malmgren | 229/120.26 |
| 2,796,213 | 6/1957 | Shanahan | 229/120.16 |
| 2,797,855 | 7/1957 | Moore | 229/120.16 |
| 2,964,230 | 12/1960 | Nemoede | 229/120.16 |
| 3,285,493 | 11/1966 | Coe et al. | 229/120.16 |
| 4,159,797 | 7/1979 | Roozee | 229/120.14 |
| 5,058,802 | 10/1991 | Rutledge | 229/120.25 |

FOREIGN PATENT DOCUMENTS

| | | | |
|---|---|---|---|
| 2498562 | 7/1982 | France | 229/120.24 |

*Primary Examiner*—Gary E. Elkins

*Attorney, Agent, or Firm*—Beveridge, DeGrandi, Weilacher & Young

[57] ABSTRACT

A carton divider comprising a structural web surrounding a plurality of preformed lateral flaps each circumscribed in part by an edge broken away from the web along a readily frangible line of weakness extending from one end to another end of a laterally extending hinge line arranged on the web. The plurality is arranged as laterally extending flap pairs, each pair comprising a laterally elongated first flap in laterally spaced relation across an intermediate isthmus of the web, from a laterally shorter second flap. A longitudinal array of such pairs have adjacent pairs with a mutually laterally reversed symmetry with laterally offset isthmuses arranged in a contiguous series forming a serpentine spine running along a central longitudinal axis of the web. The elongated flaps are arranged with proximal edges thereof adjacent the central axis in spaced relation from the axis sufficient to admit a divider insert to be positioned in upright supported relation by and between the proximal edges. A pair of generally parallel, laterally spaced apart and longitudinally extending, intermittent fold lines traverse portions of the web to define two outer web panels, and one intermediate web panel lying in a horizontal plane. The flaps are arranged in an upstanding orientation out of the horizontal plane of the web and, the two outer panels are rotated along the fold lines into a corresponding upstanding orientation in mutually engaged relation with the upstanding flaps.

33 Claims, 8 Drawing Sheets

CARTON DIVIDERS

This application is a continuation-in-part of U.S. patent application Ser. No. 07/663,027, filed Mar. 1, 1991, now U.S. Pat. No. 5,058,802, issued Oct. 22, 1991, which application is incorporated herein by reference.

FIELD OF THE INVENTION

The present invention relates to secondary packaging of the type often used for transporting a plurality of primary packages such as glass bottles (or the like) in, for example, the distribution of brewery products. More specifically this invention relates to improvements in dividers for use in such secondary packaging.

BACKGROUND OF THE INVENTION

Secondary packaging is often employed in retail packaging and distribution of brewery products. Typically such packaging is made of corrugated board or fiberboard, and, in its most familiar form, as generally rectangular cartons. Such cartons are usually provided with partitions which divide the carton's interior into a plurality of pocket-like compartments that are adapted to receive individual ones of the primary packages. This partitioning of the cartons interior serves a number of purposes, not the least of which is to hold the primary packages in mutually spaced but relatively tightly packed relation. This is intended to help avoid the breakage that direct contact between the primary packages might otherwise occasion during the course of normal handling of the carton.

The dividers are usually made up of a series of interconnected members. Depending on any one or more of a myriad of design factors, such members may be formed as part of, or affixed to, the interior walls of the carrier. More typically, however, (and especially in the case of dividers intended for use with ten or more primary beverage containers), such dividers are manufactured independently of the carton proper. They are only subsequently prior erected, if required, then inserted into the carton, most often immediately prior to the introduction of the primary containers. In many instances, the erected divider unit is not secured or affixed to the carton but is adequately, for practical purposes, maintained in position due to its length and width approximating those dimensions of the carton interior. Since the set-up and insertion steps are often mechanized operations conducted by specialized portions of available high speed packaging lines, problems may be encountered when the erected relatively tightly fitting three-dimension divider unit is inserted as such high speeds into the associated carton. For example, if the unit is overly angled relative to the plan of the carton base, then it can jam on the carton walls.

In all, dividers, to be practical and commercially suitable for such applications, must be inexpensive both in terms of their materials and their assembly/insertion costs, and yet must survive not only the initial packaging operation, but also be convenient and at least durable enough to allow them to be used by the consumer for the return of recyclable primary containers. These are fundamental considerations in adopting any divider design, particularly in relation to the packaging of bottled brewery products.

The current industry standard for dividers used in the so-called "twenty-four pack" cases, (named to reflect the number of bottles each such case is adapted to carry in a "6×4" configuration), comprises a series of eight strips of fiberboard, arranged with three such panels in a spaced, mutually parallel orientation. These are traversed at right angles by the remaining five strips, which are themselves arranged in a mutually parallel, evenly spaced apart relation. Typically the junction between any two strips is formed by the inter-nesting of opposed, complimentary slots, arranged on respective ones of the two intersecting strips. Such dividers are usually assembled by the carton manufacturer, and shipped in a collapsed condition to the brewery packaging department. In the brewery the collapsed dividers are drawn from inventory on a demand basis, shortly before cartons into which they are to be placed, are scheduled for filling. Machinery at the packaging facility "sets-up" both the required number of cartons and corresponding dividers and inserts the erected dividers within the cartons. Packing equipment then aligns the cartons (and dividers) in a predetermined orientation and drop-loads the twenty-four product filled bottles (primary containers) into their assigned compartments or pockets within the carton.

Such dividers are expensive to manufacture and handle. Yet in spite of these shortcomings, they have for many years been, and to-date still remain, the commercial solution of choice.

There exist, in the patent literature, a number of designs for packaging trays and display cartons. A sampling of such are to be found in CA U.S. Pat. No. 491,675; U.S. Pat. No. 2,697,547; and, CA U.S. Pat. No. 723,990. None of these patents contemplate any of the special considerations which obtain in respect of the packaging or distribution of bottled products in general, let alone those that arise in connection with the North American brewery products industry. Nevertheless, all have in common, the apparent purpose of providing a unitary blank replete with tab members adapted to be folded out of the plane of the blank to form a multi-compartmented divider of some sort or another. Such dividers have manufacturing, assembly, and logistical advantages over multi-part dividers such as those in use in the beer industry, (including the one described above).

CA U.S. Pat. No. 491,675 illustrates a unitary blank with a generally centrally located group of three, evenly spaced apart rectangular flaps defined, respectively, between lines of weakness on three sides, and a preformed hinge line on the fourth side. The three flaps are adapted to be broken away from the blank along the lines of weakness, and folded out of the plane of the blank into an upright posture. With this accomplished, a pair of opposed, transverse side panels defined by intermittent fold lines that traverse the length of the blank, between the flaps, can be folded upright to engage the upright flaps in mutually secured relation. The resulting girder like construction provides strength to the overall divider, and allows lighter (less expensive) materials to be used. As can be seen in FIG. 2 of that patent, however, this design still has dimensional weakness susceptible to the application of lateral forces, although whether of not this is of commercial significance depends largely on the intended application of the particular divider.

CA U.S. Pat. No. 723,990, discloses a very similar tray with respect to the overall concept involved in erecting and securing the compartment defining flaps from the blank. With regard to structural stability, this design employs a base panel that is adapted to be folded under the erected divider panel. This will greatly improve the dimensional stability of the carton/divider during the filling operation. It is a benefit which is obtained, however, only at a significant cost in additional material, as well as involving a further step in the erection process.

U.S. Pat. No. 2,697,547 discloses a third, but still similar design. The approach taken in this case attempts to deal with some of the dimensional stability issues that could arise in connection with CA U.S. Pat. No. 491,675, without necessarily requiring the additional materials cost associated with the solution put forward in CA U.S. Pat. No. 723,990. In seeking to accomplish this, U.S. Pat. No. 2,697,547 discloses a tray in which the flaps are cut as pairs arranged in lateral register on opposite sides of a central, longitudinally extending, straight spine. Each flap is folded up from a triangular root that is attached to the central spine. The provision of the wide central spine contributes to the structural stability of this divider. This design does not lend itself to or suggest applications where the central compartment is intended to be subdivided by a supported, longitudinally extending insert.

There remains a need in the art, especially as it applies to brewery products packaging, for a cost-effective, rugged carton divider.

SUMMARY OF THE INVENTION

In accordance with a broad aspect of the present invention there is provided a carton divider blank, made of self-supporting packaging material, which blank comprises a structural web lying in a horizontal plane and surrounding a plurality of preformed lateral flaps each circumscribed by a readily frangible line of weakness extending from one end to another end of a laterally extending hinge line. That plurality of flaps is arranged as laterally extending flap pairs, with each pair comprising a first flap in laterally spaced relation across an intermediate isthmus of the web, from a second flap and each such pair being longitudinally spaced from and parallel to the adjacent pair.

The pairs are in turn arranged in a longitudinal array with longitudinally parallel adjacent pairs having a mutually laterally reversed symmetry with laterally offset isthmuses arranged in a contiguous series forming a serpentine spine running along a central longitudinal axis of said web. Respective ones of the first flaps extend laterally in proximal relation to the longitudinal axis, and respective ones of said second flaps are arranged in more laterally spaced relation from the longitudinal axis.

In addition, there is provided a pair of generally parallel laterally spaced apart and longitudinally extending, intermittent fold lines traversing portions of the web that extend laterally between adjacent pairs of the longitudinal array of flaps, to define three panels in the web: two outer and one intermediate therebetween.

The flaps are adapted to be broken away along the lines of weakness and rotated about the hinge line into an upstanding orientation out of the horizontal plane of the web. Moreover, the two outer panels are adapted to be rotated along the fold lines into a corresponding upstanding orientation in mutually engaged relation with the upstanding flaps, to define a plurality of upright partitions above the horizontal plane.

The upstanding two outer panels and the intermediate panel constitute a U-shaped girder arrangement which imparts structural strength and rigidity to the divider.

In accordance with another aspect of the present invention there is provided a carton divider blank made of self-supporting packaging material. The divider comprises a structural web of such material lying in a horizontal plane and surrounding a plurality of preformed lateral flaps each circumscribed by a readily frangible line of weakness extending from one end to another end of a laterally extending hinge line, that is preformed in the web material.

Here again, this plurality of flaps is arranged in laterally extending flap pairs. Each flap pair comprises a laterally elongated first flap, which is arranged in laterally spaced relation across an intermediate isthmus of the web, from a laterally shorter second flap.

Collectively, these pairs are arranged in a longitudinal array with longitudinally adjacent pairs having a mutually laterally reversed symmetry. In other words, if, as seen from above in a plan view of the above mentioned horizontal plane, a longitudinally intermediate pair of flaps has the elongated flap disposed on the right hand side of the isthmus and the shorter flap on the left hand side, then both the adjacent pairs (that are longitudinally above and below the intermediate pair), will have their respective elongated flaps disposed to the left of the intervening isthmuses and, of course, will have their respective shorter flaps disposed on the right. One of the most immediately apparent manifestations of this feature of the invention is that the resulting lateral offset of the isthmuses will produce an arrangement in which, the contiguous series of isthmuses forms a serpentine spine running generally along a central longitudinal axis of the web.

The divider further includes a pair of generally parallel, laterally spaced apart and longitudinally extending, intermittent fold lines traversing those portions of the web that extend laterally between adjacent pairs of the longitudinal array of flaps. These fold lines define three panels in the web: two outer panels; and, one intermediate panel therebetween.

In accordance with the forgoing, the flaps are adapted to be broken away along the lines of weakness and rotated about the hinge line into an upstanding orientation extending out of the horizontal plane of the web. The two outer panels are adapted to be rotated along the fold lines into a corresponding upstanding orientation in mutually engaged relation with the upstanding flaps, to define a plurality of upright partitions above the horizontal plane.

The structural contribution of the laterally offset isthmuses is similar to that of offset cross-braces as used between studs in walls of wooden construction based on commercially standard two by four inch lumber stock. Moreover, this arrangement allows the carton to be designed to have portions of the web that remain in the horizontal plane and which are located at longitudinally intermediate locations, to be dimensioned with a sufficient lateral extent so as to facilitate machine erection of the divider. Typically, such machines rely on the use of suction cups to grasp, separate, position and otherwise manipulate the divider during the automated erection thereof, through to the installation of the erected divider into its intended carton. Such suction cups require a minimum of clear, uninterrupted surface on the web in order to draw the secure vacuum needed to facilitate the aforementioned purposes.

An additional feature which can be advantageously employed in conjunction with the practice of the present invention entails the provision of engagement means on associated flaps and/or panels whereby those members are maintained in their respective upright positions. Preferably each of the flaps and outer panels includes respective means adapted to be mutually engaged when the two are positioned in mutually aligned register, once the flaps and the outer panels are raised into their upright and corresponding upright positions, respectively. By way of example, such respective means might comprise a vertically running slit or slot arranged in an uppermost edge of each flap, and a latch means comprising an interfering, preferably depending, lobe adapted to be received in that slit or slot in interlocking relation therewith. Herein, the words "slit" and "slot" are used interchangeably.

In another and preferred embodiment the flap is provided with a cut-out portion, which may have an associated slot, and the panel with a lobe, which lobe, upon rotation of the panel and flap, is adapted to pass through the cut-out portion or the slot, contact the flap material, preferably adjacent the cut-out, and thereby be restrained and thereby maintain the flap and panel in their respective upright positions. To summarize, the engagement means maintain associated flaps and panels in their upright positions whereby they form the walls of the pockets which receive the primary containers, although in some cases, an upstanding wall of the associated carton provides a fourth wall.

Another advantageous feature can be associated with the present invention when at least one end of each of the outer panels extend longitudinally beyond the adjacent end of the intermediate panel, and the at least one ends are beveled adjacent the fold lines towards the adjacent end. This bevel is adapted to facilitate insertion of the carton divider erected from the blank, into a corresponding carton.

Yet another advantageous feature that can be employed in the practice of the present invention involves providing said flaps with a rounded profile along respective outwardly facing edges of each of the flaps. This profile is adapted to facilitate insertion of the carton divider erected from the blank, into a corresponding carton.

In another aspect, the present invention yields particular advantage with respect to allowing a divider insert to be readily installed in supported relation without necessarily occasioning undue materials or installation costs. More particularly, it is especially preferred that the elongated flaps be arranged so that at the point of their at closest approach to the central axis there is sufficient clearance left to allow a preferably flat divider insert panel to extend linearly in a relatively loose fitting but uprightly supported position between and by any three or more (as the case may be) elongated flaps of adjacent pairs. The divider insert splits each center pocket or compartment into two, preferably equal sized, pockets.

It is preferred that if such a divider insert is used that one or more of the flaps, especially the elongated flaps and/or the insert be provided with engagement means adapted to maintain the insert in position.

In accordance with the practice of the present invention as described in relation to the last above mentioned aspect thereof, there is provided a carton divider blank made of self-supporting packaging material, and more particularly one which in generally adheres to the following specification:

a structural web lying in a horizontal plane and surrounding a plurality of at least six preformed lateral flaps each circumscribed by a readily frangible line of weakness extending from one end to another end of a laterally extending hinge line;

wherein the plurality is arranged as at least three laterally extending flap pairs, with each such pair comprising a laterally elongated first flap in laterally spaced relation across an intermediate isthmus of the web, from a laterally shorter second flap;

wherein the pairs are arranged in a longitudinal array with longitudinally adjacent pairs having a mutually laterally reversed symmetry with laterally offset isthmuses arranged in a contiguous series forming a serpentine spine running along a central longitudinal axis of the web;

wherein the elongated flaps are arranged with proximal edges thereof adjacent the central axis in spaced relation from the axis sufficient to admit a divider insert to be positioned in upright supported relation by and between the proximal edges; and, a pair of generally parallel, laterally spaced apart and longitudinally extending, intermittent fold lines traversing portions of the web that extend laterally between adjacent pairs of the longitudinal array of flaps, to define three panels in the web, two outer, and one intermediate.

As before, the flaps are adapted to be broken away along the lines of weakness and rotated about the hinge line into an upstanding orientation out of the horizontal plane of the web. Similarly the two outer panels are adapted to be rotated along the fold lines into a corresponding upstanding orientation in mutually engaged relation with the upstanding flaps, to define a plurality of upright partitions above the horizontal plane.

In the embodiment specified above there are again advantages to be accrued by having the elongated flaps feature a beveled profile along respective proximal edges thereof, to thereby facilitate the insertion of the divider panel insert between flaps bordering opposed sides of the longitudinal axis, once the carton divider is erected from the specified blank.

The present invention further extends to erected carton dividers both per se, and as employed in situ in corresponding cartons. Moreover, the invention extends to in-situ dividers as hereinbefore described, in combination with their intended cartons, both prior to and following loading of goods therein. In particular the present invention embraces beer cartons enclosing the present novel divider, and to the carton/divider combination with filled or empty primary beer packaging retained in mutually separated relation therein. The invention is especially advantageous when used in conjunction with fragile contents or marable primary packaging such as, without limiting the generality of the forgoing, beer bottles.

Cartons in combination with which the present invention is especially useful, include those adapted to contain the traditional twenty-four bottles of beer. These are a commercial norm in the retail of such quantities of this product. Such cartons typically have a rectangular plan, dimensioned to accommodate the peripheral dimensions of the divider associated therewith in close fitting, readily insertable/removable relation therewith. The carton/divider combination in such embodiments usually provides twenty-four substantially separate pockets or compartments typically arranged four abreast and six deep, in a regular rectangular orientation.

As used herein frangible line of weakness indicates that the line in question is totally formed by a cut extending completely through the board material or is only partially cut through allowing easy rupture of the residual connecting portions of board material. As a practical matter, even "through" cuts by conventional die members usually result in the cut-out flap or part flap, for example, being frictionally maintained in position until it is positively displaced manually or mechanically, this action being sometimes referred to herein as "broken away".

A hinge line and fold line are used interchangeably herein to described a line or the like formed in the board material about which a flap, panel or the like may rotate.

DETAILED DESCRIPTION OF THE INVENTION

Introduction to the Drawings

Over the course of the detailed description of embodiments of the present invention that follows below, reference will be made to the accompanying drawings, in which.

Figure 1:
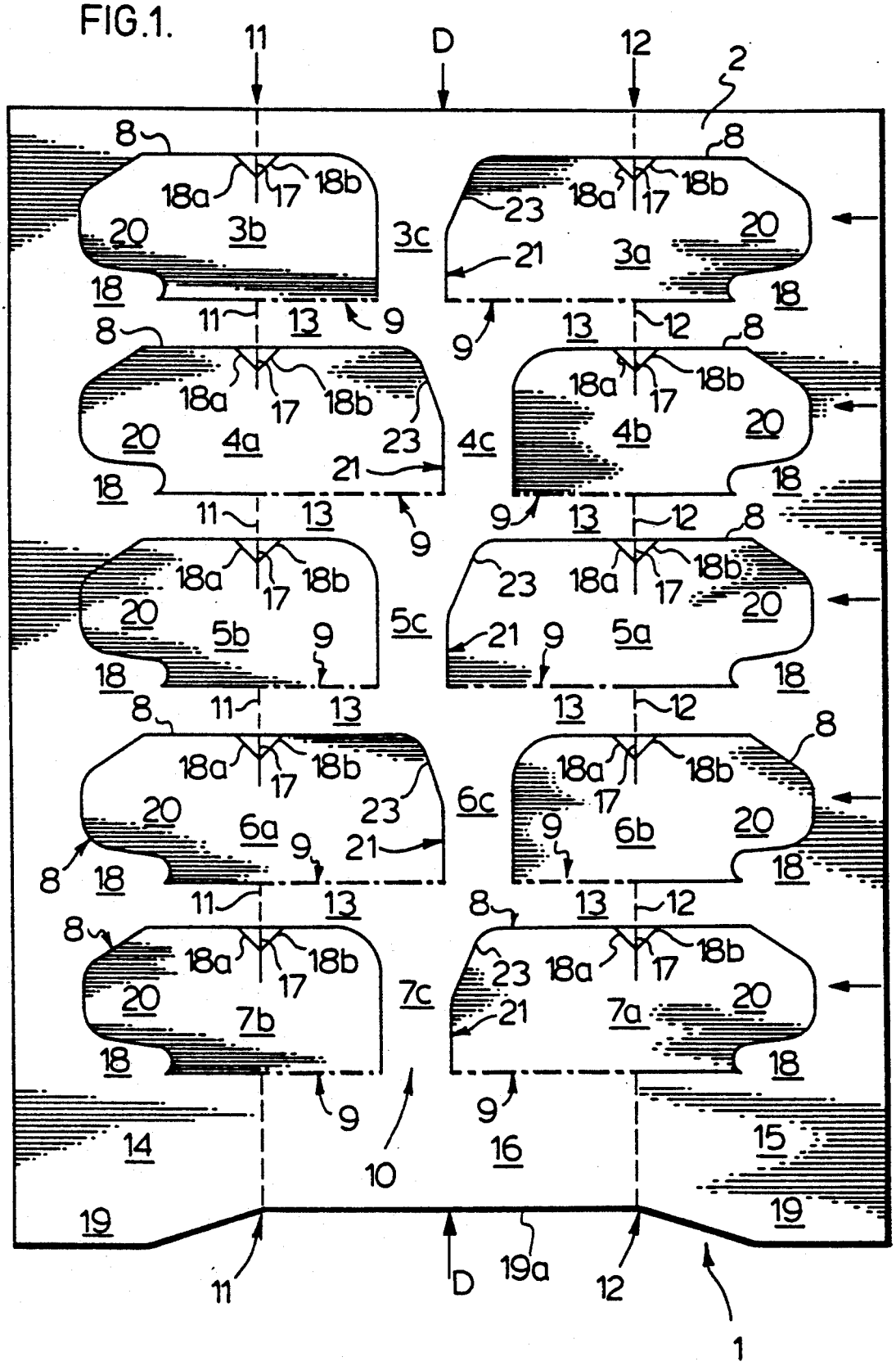
FIG. 1 is a plan view of a carton divider blank according to the present invention.

Turning now to FIG. 1 of the drawings in particular, there is illustrated a carton divider blank 1 made of self-supporting packaging material, and in particular fiberboard. The blank comprises a structural web 2 which as illustrated is lying in the horizontal plane of the attached page on which FIG. 1 has been reproduced.

Web 2 surrounds a plurality (ten in all) of preformed lateral flaps 3*a*, 3*b*, 4*a*, 4*b*, and so on through 7*a*, 7*b*. Each such flap is circumscribed by a respective readily frangible line of weakness 8 extending from one end to another and opposite end of an associated laterally extending hinge line 9. Note that although these flaps, as illustrated, do not extend laterally beyond the end of the hinge line 9 adjacent the respective isthmus, the present invention nevertheless contemplates alternative embodiments. More particularly, one embodiment within the scope of the present invention includes lateral flaps with lateral extensions overhanging the end of the hinge line adjacent the isthmus. This arrangement can be utilized to increase the surface area of the web that is locally available to be engaged by suction cups during the automated erection of the divider, in the manner already described hereinbefore. In certain applications this arrangement can be highly advantageous.

These flaps are arranged as laterally extending flap pairs 3 through 7, with each pair comprising a laterally elongated first flap (see 3*a*, 4*a*, 5*a*, 6*a*, and 7*a*) in laterally spaced relation across respective intermediate isthmuses (3*c*, 4*c*, 5*c*, 6*c*, and 7*c*, respectively) of the web 2, from a laterally shorter second flap (see 3*b*, 4*b*, 5*b*, 6*b* and 7*b*, respectively).

Each of the pairs are in turn arranged as part of a longitudinal array of pairs with longitudinally adjacent pairs having a mutually laterally reversed symmetry. The laterally offset isthmuses 3*c* through 7*c*, arranged in a contiguous series forming a serpentine spine 10 running generally along a central longitudinal axis indicated by line D—D.

A pair of generally parallel, laterally spaced apart and longitudinally extending, intermittent fold lines 11 and 12 traverse portions 13 of web 2. Portions 13 extend laterally between adjacent pairs of the longitudinal array of flaps, to define three panels in the web, two outer, 14 and 15, and one intermediate 16 therebetween.

Flaps 3*a* through 7*b* are each formed by being adapted to be pushed out of or broken away from web 2 along lines of weakness 8, and then rotated about hinge line 9 into an upstanding orientation out of said horizontal plane of the web 2. Outer panels 14 and 15 are adapted to be rotated along fold lines 11 and 12 respectively, into a corresponding upstanding orientation parallel to each other and to be secured in those positions in mutually engaged relation with the upstanding flaps 3*b*, 4*a*, 5*b*, 6*a* and 7*b*; and 3*a*, 4*b*, 5*a*, 6*b* and 7*a* respectively. Conveniently, panels 14 and 15 are rotated into position prior to the flaps 3–7. Such an assembly then defines a plurality of upright partitions above the horizontal plane occupied by intermediate panel 16.

As illustrated, the flaps 3*a* though 7*b* and the outer panels 14 and 15 all include respective means adapted to be mutually engaged when the means are positioned in mutually aligned register with the flaps and the outer panels raised into the upright and corresponding upright positions, respectively. More particularly, these respective engagement means comprise a vertically running slit 17 arranged in an uppermost edge of each flap 3*a* through 7*b*, and latch means comprising depending interfering lobes 18 adapted to be received in corresponding ones of slits 17, in interlocking relation therewith. The "Y" branched lines of weakness 18*a* and 18*b*, that are arranged in abridging relation between a spaced apart portion of the flaps free edge and an intermediate point along the longitudinal extent of the slit, laterally spaced on either side of the free edge end of each of the slits 17, facilitate the introduction and seating of lobes 18 into their corresponding slits 17. This is an especially advantageous feature if the blank is intended to be erected by machine, but is also helpful in expediting the erection process even if same is carried out manually. Moreover, the triangular portion of the flap defined by lines 18*a* and 18*b* and the line 18 may be removed in total, if desired.

The illustrated blank also makes provision for one end 19 of each of the outer panels 14 and 15 to extend longitudinally beyond the adjacent end 19*a* of the intermediate panel 16. Ends 19 are beveled adjacent the respective fold lines 11 and 12, towards the adjacent ends of 19*a*, which bevel is adapted to facilitate insertion of a carton divider erected from the blank, into a corresponding carton. Another feature adapted to facilitate insertion of the erected divider into a carton adapted to receive it, it provided by way of a rounded profile 20 along respective outwardly facing edges of each of the flaps 3*a* through 7*b*. This profile 20 is adapted to facilitate insertion the carton divider erected from said blank, into a corresponding carton, by providing a guide surface to centrally align the divider with the opening into the carton, and to minimize the amount of contacting surface between the erected divider and the carton as the divider descends past the cartons side walls, until it comes to rest at its assigned position within the carton. This is advantageous if the erected blank is angled relative to the carton base as the erected blank is being inserted into the carton.

Even more particularly, the illustrated carton blank is provided with elongated flaps 3*a*, 4*a*, 5*a*, 6*a*, and 7*a*, all of which have proximal edges 21 that are adjacent the central (longitudinal) axis of the web that is indicated by line D—D. Edges 21 are spaced from the axis sufficiently to admit a divider insert (not shown in FIG. 1, see instead FIGS. 2 and 3) to be positioned in upright supported relation by and between the edges 21, once the blank has been duly erected.

Figure 2:
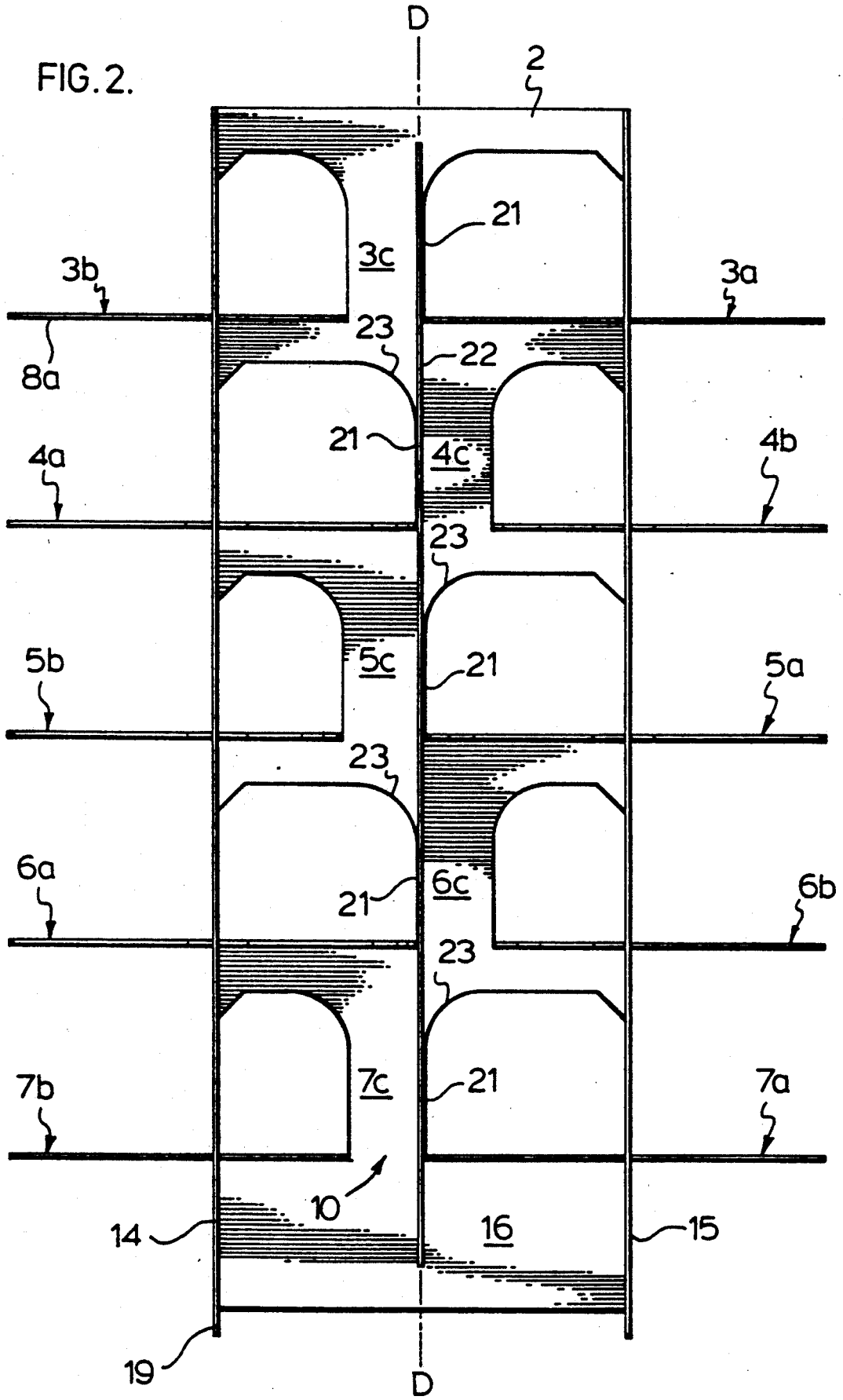
FIG. 2 is a plan view of the carton blank illustrated in FIG. 1 of the drawings erected and ready for inclusion in a standard beer carton having a 6×4 primary container configuration; and, FIG. 3 is an elevated side view of a divider insert for use in conjunction with the erected carton blank illustrated in FIG. 2.

Referring now to FIG. 2 of the drawings there is illustrated, in plan view, an erected carton divider formed from a unitary piece of self supporting packaging material. The divider is based on a structural web 2 surrounding a plurality of holes or cut-outs formed by the separation from the web 2 and subsequent rotation out of the plan thereof of preformed lateral flaps 3*a* through 7*b* inclusive. Each such flap is circumscribed in part by respective edges 8*a*, that have been broken away from the web 2 along corresponding readily frangible lines of weakness (see lines 8 in FIG. 1) that extend from one end to a laterally spaced apart another end of respective laterally extending hinge lines 9.

Here again, the plurality of flaps are arranged as laterally extending flap pairs 3, 4, 5, 6, and 7, with each pair comprising a laterally elongated first flap (3*a*, 4*a*, 5*a*, 6*a*, and 7*a*) in laterally spaced relation across an intermediate isthmus (3*c*, 4*c*, 5*c*, 6*c*, and 7*c*, respectively) of the web 2, from a laterally shorter second flap (3*b*, 4*b*, 5*b*, 6*b*, and 7*b*, respectively). These pairs 3 through 7, are arranged in a longitudinal parallel array with longitudinally adjacent pairs having a mutually laterally reversed symmetry with laterally offset isthmuses 3*c* through 7*c* inclusive, arranged in a contiguous series forming a serpentine spine 10 running along a generally central longitudinal axis of said web, (indicated by line D—D).

As can be clearly seen in the view afforded in FIG. 2, the elongated flaps 3*a*, 4*a*, 5*a*, 6*a*, and 7*a*, are arranged with proximal edges 21 thereof adjacent the central axis, in spaced relation from the axis sufficient to admit a divider insert 22 to be positioned in upright supported relation by and between the proximal edges 21.

The web 2 has a generally "U" shaped cross-section formed around a pair of generally parallel, laterally spaced apart and longitudinally extending, intermittent fold lines 11 and 12, each of which traverse portions of the web 2 that extend laterally between adjacent pairs of the longitudinal array of flaps. Fold lines 11 and 12 effectively define three panels in the web 2: two outer panels 14 and 15; and, one intermediate panel 16, lying in the horizontal plane of the page which FIG. 2 is reproduced.

Also note that flaps 3*a*, 4*a*, 5*a*, 6*a*, and 7*a*, all have a beveled profile 23 along respective proximal edges 21 thereof, this adaption facilitates the insertion of a divider panel insert 22 between flaps bordering on opposed sides of the longitudinal axis indicated by line D—D.

Figure 3:
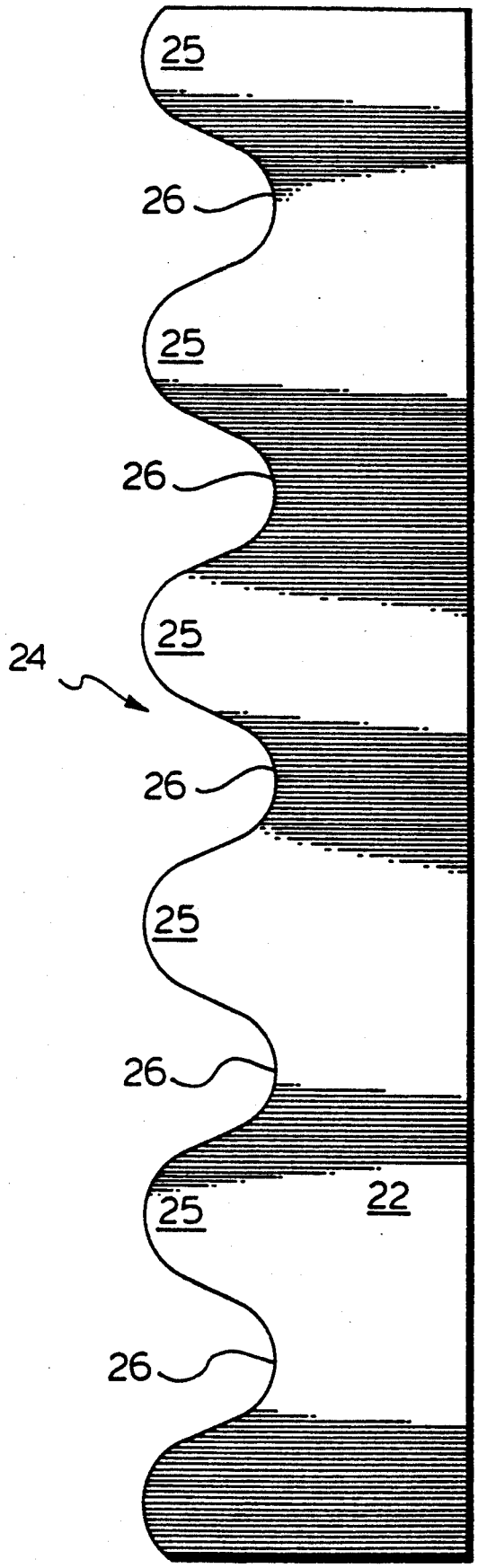
Figure 4:
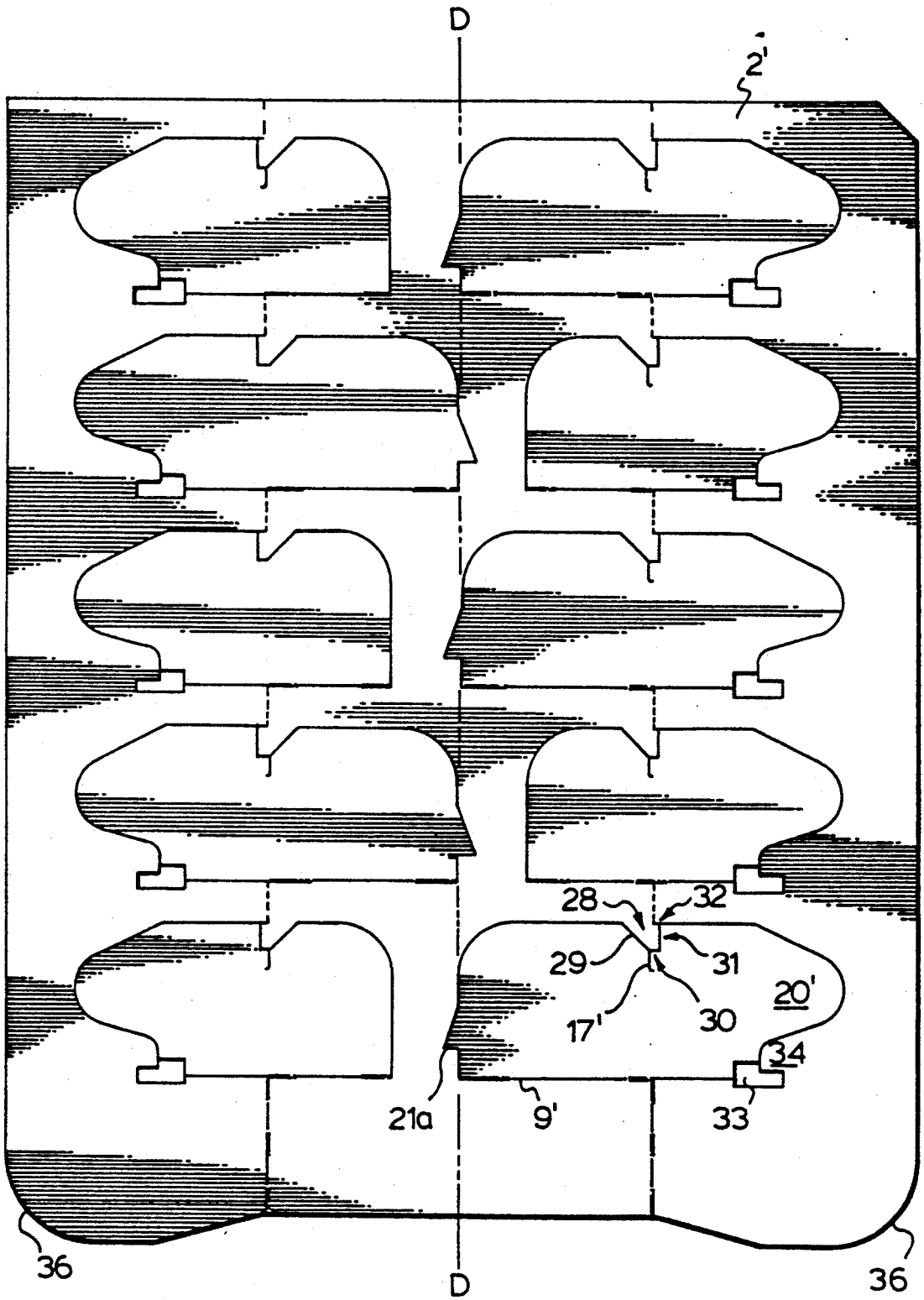
FIG. 4 is a plan view of a preferred carton divider blank according to the present invention.
Figure 5:
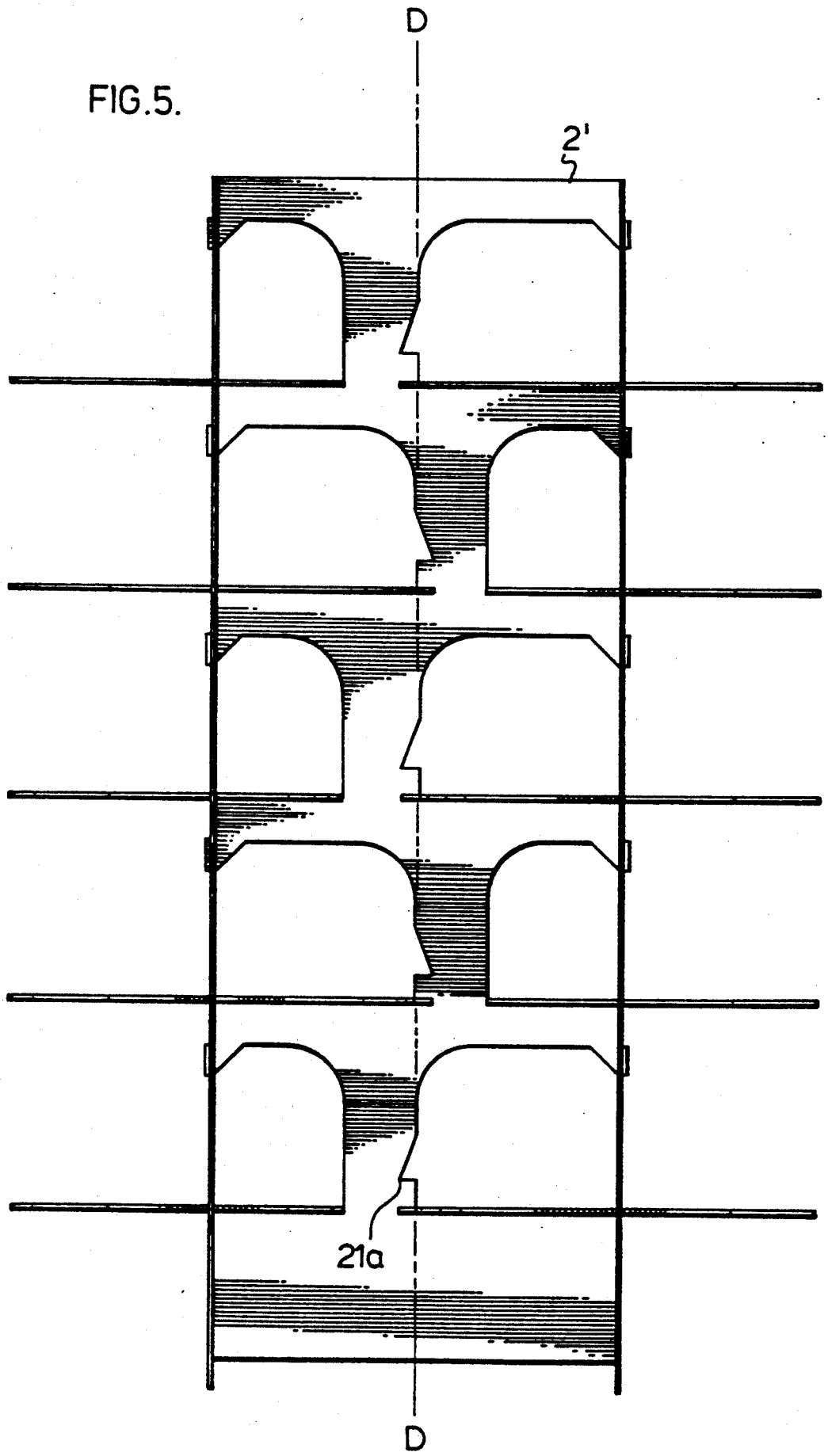
FIG. 5 is a plan view of the carton divider of FIG. 4 erected and ready for inclusion in a standard beer carton having a 6×4 primary container configuration.
Figure 6:
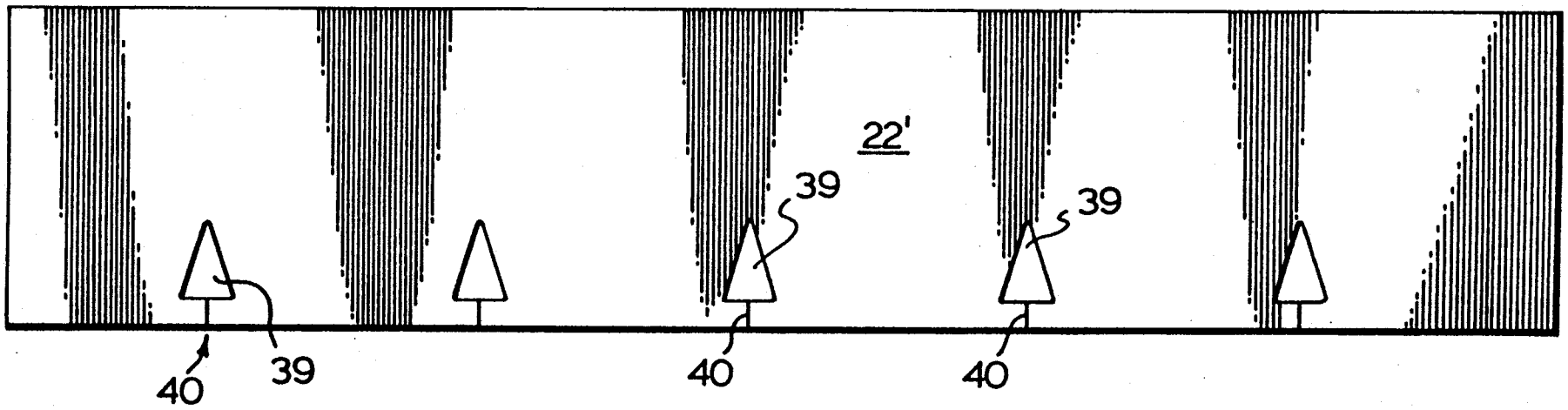
FIG. 6 is a side elevation of a preferred form of divider insert for use in association with the carton divider of FIGS. 4 and 5.

Referring now to FIG. 3 of the drawings, there is illustrated a divider insert 22 which comprises an elongated strip of self supporting packaging material having a scalloped profile 24 along one elongated edge. A regular longitudinally extending series of alternating crests 25 and troughs 26 are characteristic of profile 24. Profile 24 is adapted to interleavingly engage portions of upwardly facing edges of the flaps 3*a*, 4*a*, 5*a*, 6*a*, and 7*a*, to guide the divider insert 22 into a predetermined axial register by locating the upwardly facing edges of these flaps within troughs 26. Although a variety of advantages can be accrued through the use of such an embellished divider in conjunction with the divider blank of the present invention, a simple rectangular divider can also be used, and by reason of that simplicity alone, is Possessed of certain advantages, not the least of which arise in connection with the corresponding simplicity with which the plain rectangular dividers can be manufactured and handled. As a consequence of these last above mentioned advantages, such simple rectangular dividers are in some instances commercially preferable, notwithstanding the technical advantages that are otherwise associated with the divider as shown in FIG. 3.

Turning to FIGS. 4–8, these illustrates a further and preferred forms of the various aspects of the present invention. In these figures, parts common to the divider blank, divider unit, etc. of FIGS. 1–3 and that of FIGS. 4–8 have been identified by the same numbers but each such number in the latter FIGS. is qualified by prime (′). This preferred form of divider blank, divider unit, etc., differ from that previously described in the following ways:

1. Each elongated flap 3′*a*, 4′*a*, 5′*a*, 6′*a* and 7′*a* is provided with a triangular shaped locking member 21*a* extending laterally across the longitudinal axis D—D of the web from the edges 21 of each such elongated flap, the horizontal base line of each portion 21*a* being parallel to and spaced longitudinally from hingeline 9′ associated with each respective elongated flap 3*a* through 7*a*. Other forms of locking members may also be used, member 21*a* being preferred since it may be made simultaneously with the remainder of the blank and with no additional material requirement.

Figure 7:
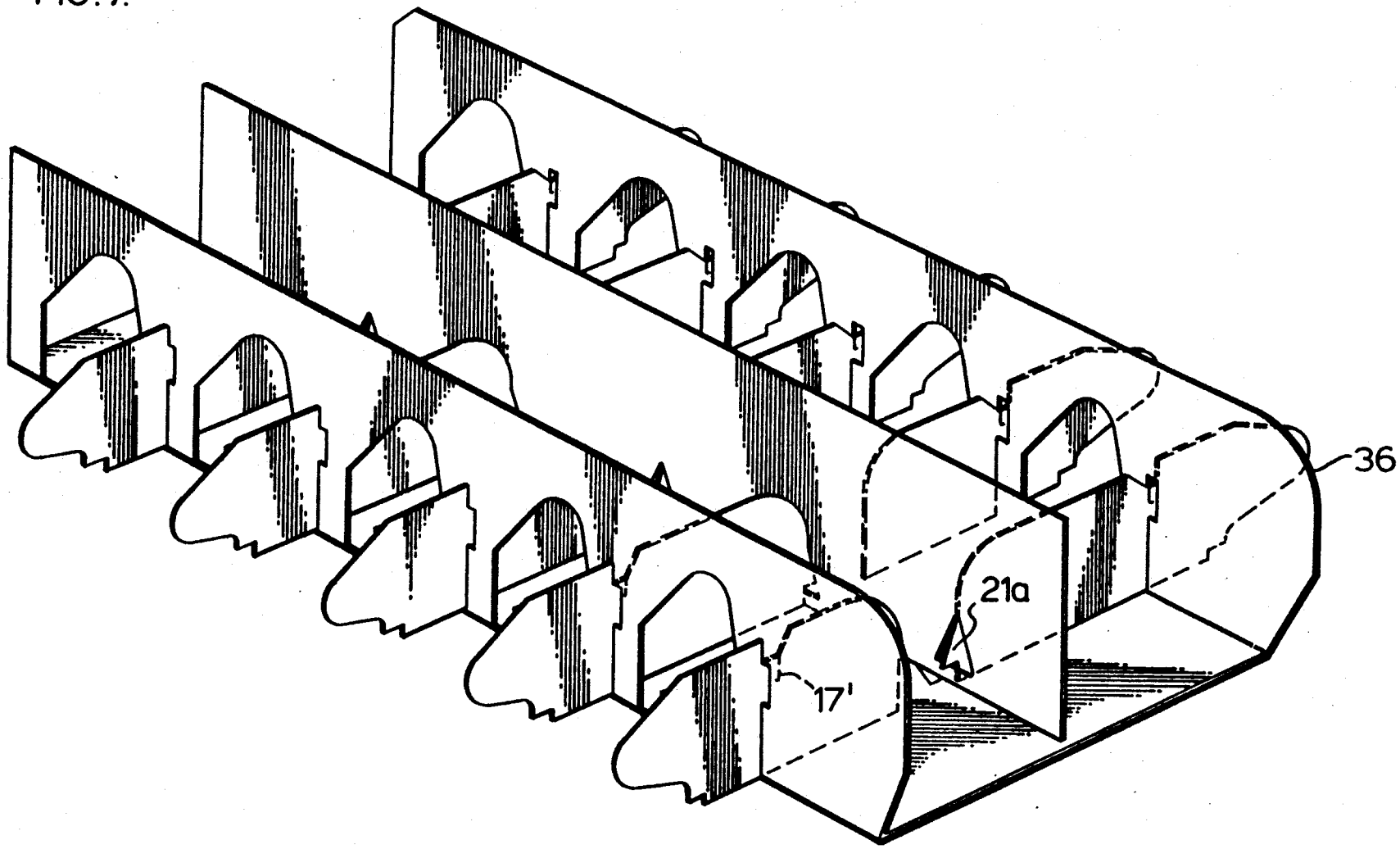
FIG. 7 is an angled perspective view from above of the erected carton divider blank of FIGS. 4 and 5 with the divider insert of FIG. 6 in position.

2. The engaging means by which each flap 3′–7′ engages its associated panel 14′ or 15′ has been changed to provide greater flexibility. In particular a trapezoid rhomboid shaped locking member 28 is formed in each of the flaps by frangible line 29, 30, 31 and 32. an L-shaped portion 33 comprised of part of each flap 3′–7′ and associated lobe 20′ is removed, this forming lobe 34 which as is readily seen in FIG. 7, is adapted to pass through running slot 17′ and then engage and be restrained by the portion of the flap immediately below and adjacent line 30 upon rotation of the flap to its upstanding position. It may be noted that, when each flap and panel are locked in position, the vertical edge of lobe 34 and the slot 17′ are not aligned, the width of line 30 allowing for some lateral displacement of tab 34, from slot 17′. Consequently, there is little or no tendency for tab 34 to slip back through slot 17′ and thereby allow disengagement of a flap from its associated panel.

3. The outer edges 36 of panels 19' are rounded, this assisting in eliminating any tendency for the erected divider to jam upon its being inserted into a carton 40, if the divider unit becomes angled relative to the plane of the carton base. It should be borne in mind that the lateral and longitudinal dimensions of the erected divider unit are very similar to those of the carton interior leaving limited tolerance for error during insertion.

4. A corner 38 of the web has been cut off, this serving to indicate the orientation of the blank and divider and ensure the divider blank is always inserted in the magazine of its erecting equipment in the correct orientation.

Figure 8:
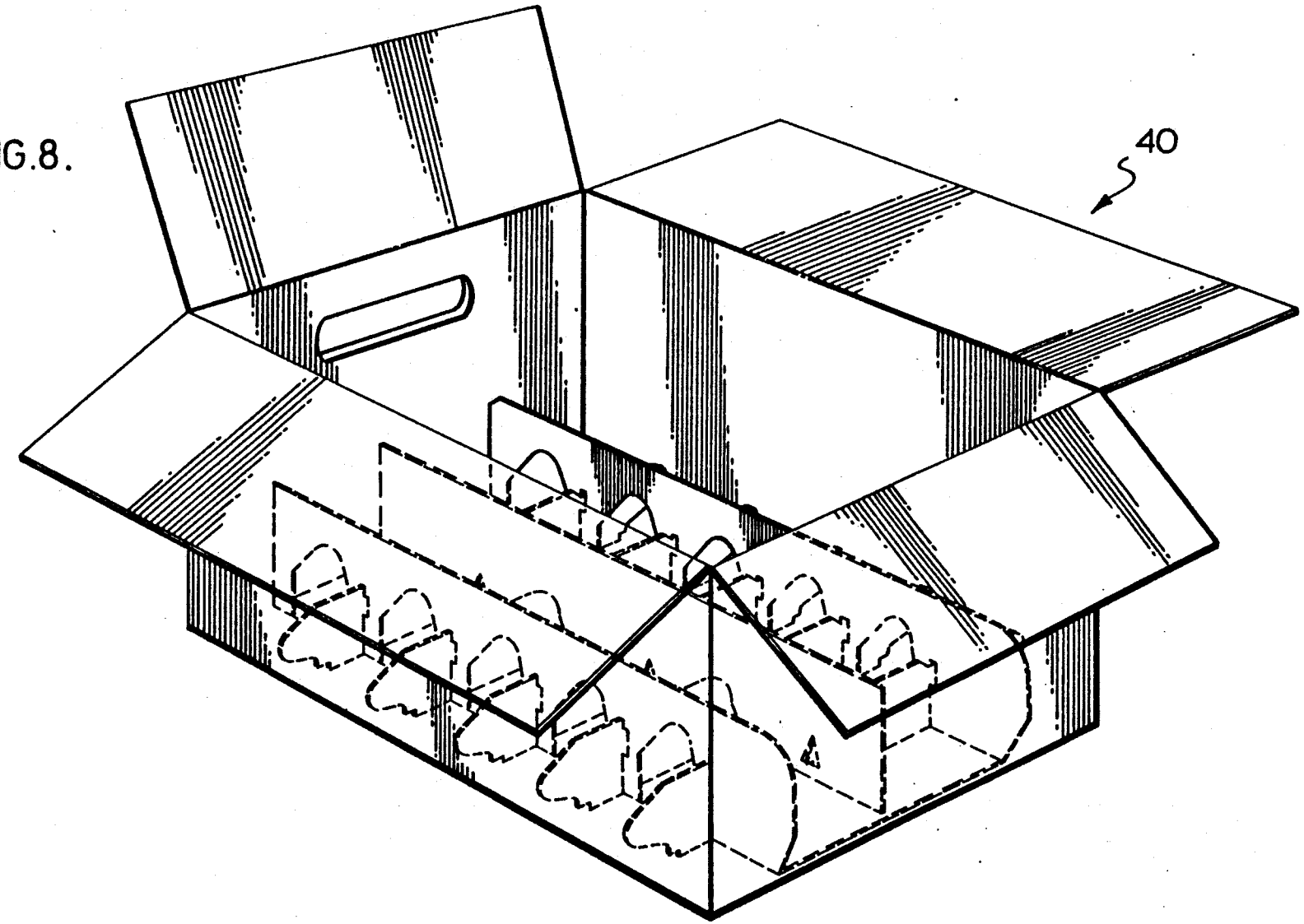
FIG. 8 is an angled perspective view from above of the erected divider - insert unit of FIG. 7 in place inside a conventional "6×4" configuration carton shell.

Turning specifically to FIG. 8, this shows the complete divider assembly or unit of FIG. 7 in position in a carton or carton shell, 40. This carton is the regular "24", or "2-4" as it is colloquially known, which has 24 bottle containing pockets or compartments in a 6×4 array. As can be seen, the divider unit fits snugly in the container.

It may be noted that the width of the panels and flaps, which become the "height" of those members when the divider blank is formed into the divider unit, are shown to be approximately half the height of the carton walls. The "height" of the panels and flaps may be varied at will and is generally chosen to ensure that the bottles or other containers to be carried by the container are provided with the desired degree of protection from adjacent bottles or similar containers.

THE EMBODIMENTS OF THE INVENTION IN WHICH AN EXCLUSIVE PROPERTY OR PRIVILEGE IS CLAIMED ARE DEFINED AS FOLLOWS:

1. A carton divider blank made of self-supporting packaging material, and comprising:

a structural web lying in a horizontal plane and surrounding a plurality of at least four preformed lateral flaps each circumscribed by a readily frangible line of weakness extending from one end to another end of a laterally extending hinge line;

said plurality being arranged to constitute laterally extending flap pairs, each pair comprising a laterally elongated first flap in laterally spaced relation across an intermediate isthmus of said web, from a laterally shorter second flap;

said pairs being arranged in a longitudinal array with longitudinally adjacent pairs having a mutually laterally reversed symmetry with laterally offset isthmuses arranged in a contiguous series forming a serpentine spine running along a central longitudinal axis of said web; and, a pair of generally parallel, laterally spaced apart and longitudinally extending, intermittent fold lines traversing portions of said web that extend laterally between adjacent pairs of said longitudinal array of flaps, to define three panels in said web, two outer, and one intermediate therebetween, wherein said flaps are adapted to be broken away along said lines of weakness and rotated about said hinge line into an upstanding orientation out of said horizontal plane of said web; and, wherein said two outer panels are adapted to be rotated along said fold lines into a corresponding upstanding orientation in mutually engaged relation with said upstanding flaps, to define a plurality of upright partitions above said horizontal plane.

2. The blank according to claim 1 wherein each of said flaps and said outer panels include respective ones of corresponding flap inter-engagement means and outer panel inter-engagement means adapted to be mutually interengaged in paired relation when positioned in mutually aligned register when said flaps and said outer panels are raised into said upright and corresponding upright positions, respectively.

3. The blank according to claim 2 wherein said respective means comprise a vertically running slit arranged in an uppermost edge of each said flap, and a latch means comprising a depending interfering lobe adapted to be received in said slit in interlocking relation therewith.

4. The blank according to claim 2 wherein each of said flap inter-engagement means comprises cut-out means arranged in an uppermost edge of each said flap with a slot extending from a base of said cut-out means; and, each of corresponding ones of said outer panel interengagement means comprises latch means on said outer panel each comprising an interfering lobe, at least part of which is adapted to pass through said cut-out and overlie and be restrained by an adjacent portion of a corresponding one of said flaps.

5. The blank according to claim 4 wherein each said lobe is adapted to contact its respective adjacent portion on its corresponding flap which portion is location in adjacent but laterally spaced apart relation to a corresponding one of said slots.

6. The blank according to claim 1 wherein at least one end of each of said outer panels extend longitudinally beyond the same adjacent end of the intermediate panel, said at least one ends being beveled adjacent the fold lines towards said adjacent end, which bevel is adapted to facilitate insertion of a carton divider erected from said blank, into a corresponding carton.

7. The blank according to claim 6 wherein each said adjacent end has a rounded profile to additionally facilitate insertion of a carton divider erected from said blank into an associated carton.

8. The blank according to claim 1 wherein said flaps have a rounded profile along respective outwardly facing edges of each of said flaps which profile is adapted to facilitate insertion of said carton divider erected from said blank, into a corresponding carton.

9. The blank according to claim 2 wherein at least the longitudinally outer two elongated flaps are provided with said means for engaging said divider insert.

10. A carton blank of self-supporting packaging material, comprising:

a structural web lying in a horizontal plane and surrounding a plurality of at least six preformed lateral flaps each circumscribed by a readily flangible line of weakness extending from one end to another end of a laterally extending hinge line;

said plurality being arranged to constitute at least three laterally extending flap pairs, each such pair comprising a laterally elongated first flap in laterally spaced relation across an intermediate isthmus of said web, from a laterally shorter second flap;

said pairs being arranged in a longitudinal array with longitudinally adjacent pairs having a mutually laterally reversed symmetry with laterally offset isthmuses arranged in a contiguous series forming a serpentine spine running along a central longitudinal axis of said web;

said elongated flaps arranged with proximal edges thereof adjacent said central axis in spaced relation from said axis sufficient to admit a divider insert to be positioned in upright supported relation by and between said proximal edges; and, a pair of generally parallel, laterally spaced apart and longitudinally extending, intermittent fold lines traversing portions of said web that extend laterally between adjacent pairs of said longitudinal array of said flaps, to define three panels in said web, two outer, and one intermediate therebetween, wherein said flaps are adapted to be broken away along said lines of weakness and to rotate about said hinge lines into an upstanding orientation out of said horizontal plane; and, wherein said two outer panels are adapted to be rotated along said fold lines into a corresponding upstanding orientation in mutually engaged relation with said upstanding flaps, with the engaged flaps and panels thereby defining a plurality of upright partitions above said horizontal plane; and, wherein at least some of said flaps have a beveled profile along respective proximal edges thereof, adapted to facilitate the insertion of said divider panel insert along said longitudinal axis in a carton divider erected from said blank; and, wherein at least one of said flaps has means on a proximal edge thereof adapted to engage said divider insert in a carton divider erected from said blank.

11. The blank according to claim 10 wherein at least the longitudinally outer two elongated flaps are provided with said means for engaging said divider insert.

12. A carton divider formed from a unitary piece of self supporting packaging material, and comprising:

a structural web surrounding a plurality of preformed lateral flaps each circumscribed in part by an edge broken away from said web along a readily frangible line of weakness extending from one end to another end of a laterally extending hinge line arranged on said web;

said plurality being arranged as laterally extending flap pairs, each pair comprising a laterally elongated first flap in laterally spaced relation across an intermediate isthmus of said web, from a laterally shorter second flap;

said pairs being arranged in a longitudinal array with longitudinally adjacent pairs having a mutually laterally reversed symmetry with laterally offset isthmuses arranged in a contiguous series forming a serpentine spine running along a central longitudinal axis of said web;

a pair of generally parallel, laterally spaced apart and longitudinally extending, intermittent fold lines traversing portions of said web that extend laterally between adjacent pairs of said longitudinal array of flaps, defining three panels in said web including two outer panels, and one intermediate panel laying in a horizontal plane;

said flaps being rotated along said fold lines into a corresponding upstanding orientation in mutually engaged relation with said upstanding flaps, thereby defining a plurality of upright partitions above said horizontal plane of said intermediate panel; and, wherein said flaps and said outer panels each include respective mutually engaged means positioned in mutually aligned register with said flaps and said outer panels in said upright and corresponding upright positions, respectively; and, wherein said respective mutually engaged means each comprise a vertically running slit arranged in an uppermost edge of each said flap, and a latch means comprising an interfering lobe at least part of which is received in a corresponding slit in interlocking relation therewith.

13. The carton divider according to claim 1 in which each said lobe depends from a corresponding one of said flaps.

14. A carton divider formed from a unitary piece of self supporting packaging material, and comprising:

a structural web surrounding a plurality of preformed lateral flaps each circumscribed in part by an edge broken away from said web along a readily frangible line of weakness extending from one end to another end of a laterally extending hinge line arranged on said web;

said plurality being arranged as laterally extending flap pairs, each pair comprising a laterally elongated first flap in laterally spaced relation across an intermediate isthmus of said web, from a laterally shorter second flap;

said pairs being arranged in a longitudinal array with longitudinally adjacent pairs having a mutually laterally reversed symmetry with laterally offset isthmuses arranged in a contiguous series forming a serpentine spine running along a central longitudinal axis of said web;

a pair of generally parallel, laterally spaced apart and longitudinally extending, intermittent fold lines traversing portions of said web that extend laterally between adjacent pairs of said longitudinal array of flaps, defining three panels in said web including two outer panels, and one intermediate panel laying in a horizontal plane;

said flaps being rotated along said fold lines into a corresponding upstanding orientation in mutually engaged relation with said upstanding flaps, thereby defining a plurality of upright partitions above said horizontal plane of said intermediate panel; and, wherein said flaps and said outer panels each include respective mutually engaged means comprising flap inter-engagement means and outer panel inter-engagement means positioned in mutually aligned register with said flaps and said outer panels in said upright and corresponding upright positions, respectively; and, wherein each of aid flap inter-engagement means comprises cut-out means arranged in an uppermost edge of each said flap with a slot extending from a base of said cut-out means; and, said outer panel inter-engagement means comprises latch means on said outer panel each comprising an interfering lobe, at least part of which is adapted to pass through said cut-out and overlie and be restrained by an adjacent portion of said flap.

15. The carton divider according to claim 1 wherein each said lobe is adapted to contact its respective adjacent portion on its corresponding flap which portion is located in adjacent but laterally spaced apart relation to a corresponding one of said slots.

16. A carton divider formed from a unitary piece of self supporting packaging material, comprising:

a structural web surrounding a plurality of preformed lateral flaps each circumscribed in part by an edge broken away from said web along a readily frangible line of weakness extending from one end to another end of a laterally extending hinge line arranged on said web;

said plurality being arranged as laterally extending flap pairs, each pair comprising a laterally elongated first flap in laterally spaced relation across in intermediate isthmus of said web, from a laterally shorter second flap;

said pairs being arranged in a longitudinal array with longitudinally adjacent pairs having a mutually laterally reversed symmetry with laterally offset isthmuses arranged in a contiguous series forming a serpentine spine running along a central longitudinal axis of said web;

a pair of generally parallel, laterally spaced apart and longitudinally extending, intermittent fold lines traversing portions of said web that extend laterally between adjacent pairs of said longitudinal array of flaps, defining three panels in said web including two outer panels, and one intermediate panel laying in a horizontal plane;

said flaps being rotated along said fold lines into a corresponding upstanding orientation in mutually engaged relation with said upstanding flaps, thereby defining a plurality of upright partitions above said horizontal plane of said intermediate panel; and, wherein at least one end of each of said outer panels extends longitudinally beyond the adjacent end of the intermediate panel, said at least one end being beveled adjacent the fold lines towards said adjacent end, which bevel is adapted to facilitate insertion of said carton divider into a corresponding carton.

17. A carton divider formed from a unitary piece of self supporting packaging material, and comprising:

a structural web surrounding a plurality of preformed lateral flaps each circumscribed in part by an edge broken away from said web along a readily frangible line of weakness extending from one end to another end of a laterally extending hinge line arranged on said web;

said plurality being arranged as laterally extending flap pairs, each pair comprising a laterally elongated first flap in laterally spaced relation across an intermediate isthmus of said web, from a laterally shorter second flap;

said pairs being arranged in a longitudinal array with longitudinally adjacent pairs having a mutually laterally reversed symmetry with laterally offset isthmuses arranged in a contiguous series forming a serpentine spine running along a central longitudinal axis of said web;

a pair of generally parallel, laterally spaced apart and longitudinally extending, intermittent fold lines traversing portions of said web that extend laterally between adjacent pairs of said longitudinal array of flaps, defining three panels in said web including two outer panels, and one intermediate panel laying in a horizontal plane;

said flaps being rotated along said fold lines into a corresponding upstanding orientation in mutually engaged relation with said upstanding flaps, thereby defining a plurality of upright partitions above said horizontal plane of said intermediate panel; and, wherein at least two of said flaps have a beveled profile along respective proximal edges thereof, adapted to facilitate the insertion of a divider-panel insert along said longitudinal axis.

18. The carton divider according to claim 17 wherein at least the longitudinally outer two elongated flaps are provided with said means for engaging said divider insert.

19. The carton divider according to claim 17 which further includes a divider insert.

20. A carton divider formed from a unitary piece of self supporting packaging material, and comprising:

a structural web surrounding a plurality of preformed lateral flaps each circumscribed in part by an edge broken away from said web along a readily frangible line of weakness extending from one end to another end of a laterally extending hinge line arranged on said web;

said plurality being arranged as laterally extending flap pairs, each pair comprising a laterally elongated first flap in laterally spaced relation across an intermediate isthmus of said web, from a laterally shorter second flap;

said pairs being arranged in a longitudinal array with longitudinally adjacent pairs having a mutually laterally reversed symmetry with laterally offset isthmuses arranged in a contiguous series forming a serpentine spine running along a central longitudinal axis of said web;

a pair of generally parallel, laterally spaced apart and longitudinally extending, intermittent fold lines traversing portions of said web that extend laterally between adjacent pairs of said longitudinal array of flaps, defining three panels in said web including two outer panels, and one intermediate panel laying in a horizontal plane;

said flaps being rotated along said fold lines into a corresponding upstanding orientation in mutually engaged relation with said upstanding flaps, thereby defining a plurality of upright partitions above said horizontal plane of said intermediate panel; and, wherein at least one of said elongated flaps has means on a proximal edge thereof adapted to engage a divider insert to be located along said longitudinal axis.

21. A carton divider formed from a unitary piece of self supporting packaging material, and comprising:

a structural web surrounding a plurality of preformed lateral flaps each circumscribed in part by an edge broken away from said web along a readily frangible line of weakness extending from one end to another end of a laterally extending hinge line arranged on said web;

said plurality being arranged as laterally extending flap pairs, each pair comprising a laterally elongated first flap in laterally spaced relation across an intermediate isthmus of said web, from a laterally shorter second flap;

said pairs being arranged in a longitudinal array with longitudinally adjacent paris having a mutually laterally reversed symmetry with laterally offset isthmuses arrange in a contiguous series forming a serpentine spine running along a central longitudinal axis of said web;

said elongated flaps arranged with proximal edges thereof adjacent said central axis in spaced relation from said axis sufficient to admit a divider insert to be positioned in upright supported relation by and between said proximal edges; and, a pair of generally parallel, laterally spaced apart and longitudinally extending, intermittent fold lines traversing portions of said web that extend laterally between adjacent pairs of said longitudinal array of flaps, defining three panels in said web including two outer panels, and one intermediate panel lying in a horizontal plane;

said flaps being rotate about said hinge line into an upstanding orientation out of said horizontal plane of said web; and, said two outer panels being rotated along said fold lines into a corresponding upstanding orientation in mutually engaged relation with said upstanding flaps, thereby defining a plurality of upright partitions above said horizontal plane of said intermediate panel; and, wherein at least one of said elongated flaps has means on a proximal edge thereof adapted to engage a divider insert to be located along said longitudinal axis.

22. A carton divider formed from a unitary piece of self supporting packaging material, and comprising:

a structural web surrounding a plurality of preformed lateral flaps each circumscribed in part by an edge broken away from said web along a readily frangible line of weakness extending from one end to another end of a laterally extending hinge line arranged on said web;

said plurality being arranged as laterally extending flap pairs, each pair comprising a laterally elongated first flap in laterally spaced relation across an intermediate isthmus of said web, from a laterally shorter second flap;

said pairs being arranged in a longitudinal array with longitudinally adjacent paris having a mutually laterally reversed symmetry with laterally offset isthmuses arrange in a contiguous series forming a serpentine spine running along a central longitudinal axis of said web;

said elongated flaps arranged with proximal edges thereof adjacent said central axis in spaced relation from said axis sufficient to admit a divider insert to be positioned in upright supported relation by and between said proximal edges; and, a pair of generally parallel, laterally spaced apart and longitudinally extending, intermittent fold lines traversing portions of said web that extend laterally between adjacent pairs of said longitudinal array of flaps, defining three panels in said web including two outer panels, and one intermediate panel lying in a horizontal plane;

said flaps being rotate abut said hinge line into an upstanding orientation out of said horizontal plane of said web; and, said two outer panels being rotated along said fold lines into a corresponding upstanding orientation in mutually engaged relation with said upstanding flaps, thereby defining a plurality of upright partitions above said horizontal plane of said intermediate panel; and, wherein said flaps and said outer panels each include respective mutually engaged means comprising flap inter-engagement means and outer panel inter-engagement means positioned in mutually aligned register with said flaps and said outer panels in said upright and corresponding upright positions, respectively; and, wherein each of aid flap inter-engagement means comprises cut-out means arranged in an uppermost edge of each said flap with a slot extending from a base of said cut-out means; and, corresponding ones of said outer panel inter-engagement means comprises latch means on said outer panel each comprising an interfering lobe, at least part of which is adapted to pass through said cut-out and overlie and be restrained by an adjacent portion of said flap.

23. The carton divider according to claim 22 wherein said lobe is adapted to contact its respective adjacent portion on its corresponding flap which portion is located in adjacent but laterally spaced apart relation to a corresponding one of said slots.

24. A carton and carton divider formed from a unitary piece of self supporting packaging material, and comprising in combination;

a structural web surrounding a plurality of preformed lateral flaps each circumscribed in part by an edge broken away from said web along a readily frangible line of weakness extending from one end to another end of a laterally extending hinge line arranged on said web;

sad plurality being arranged as laterally extending flap pairs, each pair comprising a laterally elongated first flap in laterally spaced relation across an intermediate isthmus of said web, from a laterally shorter second flap;

said pairs being arranged in a longitudinal array with longitudinally adjacent paris having a mutually laterally reversed symmetry with laterally offset isthmuses arrange in a contiguous series forming a serpentine spine running along a central longitudinal axis of said web;

said elongated flaps arranged with proximal edges thereof adjacent said central axis in spaced relation from said axis sufficient to admit a divider insert to be positioned in upright supported relation by and between said proximal edges; and, a pair of generally parallel, laterally spaced apart and longitudinally extending, intermittent fold lines traversing portions of said web that extend laterally between adjacent pairs of said longitudinal array of flaps, defining three panels in said web including two outer panels, and one intermediate panel lying in a horizontal plane;

said flaps being rotated about said hinge line into an upstanding orientation out of said horizontal plane of said web; and, said two outer panels being rotated along said fold lines into a corresponding upstanding orientation in mutually engaged relation with said upstanding flaps, thereby defining a plurality of upright partitions above said horizontal plane of said intermediate panel;

wherein said flaps have a rounded profile along respective outwardly facing edges thereof which profile is adapted to facilitate insertion of said carton divider into a corresponding carton; and a corresponding carton with said divider arranged in combination therewith.

25. A carton divider formed from a unitary piece of self supporting packaging material, and comprising:

a structural web surrounding a plurality of preformed lateral flaps each circumscribed in part by an edge broken away from said web along a readily frangible line of weakness extending from one end to another end of a laterally extending hinge line arranged on said web;

said plurality being arranged as laterally extending flap pairs, each pair comprising a laterally elongated first flap in laterally spaced relation across an intermediate isthmus of said web, from a laterally shorter second flap;

said pairs being arranged in a longitudinal array with longitudinally adjacent paris having a mutually laterally reversed symmetry with laterally offset isthmus arrange in a contiguous series forming a serpentine spine running along a central longitudinal axis of said web;

said elongated flaps arranged with proximal edges thereof adjacent said central axis in spaced relation from said axis sufficient to admit a divider insert to be positioned in upright supported relation by and between said proximal edges; and, a pair of generally parallel, laterally spaced apart and longitudinally extending, intermittent fold lines traversing portions of said web that extend laterally between adjacent pairs of said longitudinal array of flaps, defining three panels in said web including two outer panels, and one intermediate panel lying in a horizontal plane;

said flaps being rotate about said hinge line into an upstanding orientation out of said horizontal plane of said web; and, said two outer panels being rotated along said fold lines into a corresponding upstanding orientation in mutually engaged relation with said upstanding flaps, thereby defining a plurality of upright partitions above said horizontal plane of said intermediate panel; and, wherein said flaps have a rounded profile along respective outwardly facing edges each of aid flaps which profile is adapted to facilitate insertion of said carton divider erected from said blank, into a corresponding carton.

26. The carton divider according to claim 25, wherein at least one of said flaps has means on a proximal edge thereof adapted to engage a divider insert to be located along said longitudinal axis.

27. The carton divider according to claim 26 wherein at least the longitudinally outer two elongated flaps are provided with said means for engaging said divider insert.

28. A carton divider as claimed in claim 25 in combination with a divider insert.

29. A carton divider formed from a unitary piece of self supporting packaging material, and comprising:

a structural web surrounding a plurality of preformed lateral flaps each cirscribed in part by an edge broken away from said web along a readily frangible line of weakness extending from one end to another end of a laterally extending hinge line arranged on said web;

said plurality being arranged as laterally extending flap pairs, each pair comprising a laterally elongated first flap in laterally spaced relation across an intermediate isthmus of said web, from a laterally shorter second flap;

said pairs being arranged in a longitudinal array with longitudinally adjacent paris having a mutually laterally reversed symmetry with laterally offset isthmuses arrange in a contiguous series forming a serpentine spine running along a central longitudinal axis of said web;

said elongated flaps arranged with proximal edges thereof adjacent said central axis in spaced relation from said axis sufficient to admit a divider insert to be positioned in upright supported relation by and between said proximal edges; and, a pair of generally parallel, laterally spaced apart and longitudinally extending, intermittent fold lines traversing portions of said web that extend laterally between adjacent pairs of said longitudinal array of flaps, defining three panels in said web including two outer panels, and one intermediate panel lying in a horizontal plane;

said flaps being rotate about said hinge line into an upstanding orientation out of said horizontal plane of said web; and, said two outer panels being rotated along said fold lines into a corresponding upstanding orientation in mutually engaged relation with said upstanding flaps, thereby defining a plurality of upright partitions above said horizontal plane of said intermediate panel;

in combination with a divider insert, which insert is provided with means to engage an at least one of said flap's proximal edge.

30. A carton divider formed from a unitary piece of self supporting packaging material, and comprising:

a structural web surrounding a plurality of preformed lateral flaps each circumscribed in part by an edge broken away from said web along a readily frangible line of weakness extending from one end to another end of a laterally extending hinge line arranged on said web;

said plurality being arranged as laterally extending flap pairs, each pair comprising a laterally elongated first flap in laterally spaced relation across an intermediate isthmus of said web, from a laterally shorter second flap;

said pairs being arranged in a longitudinal array with longitudinally adjacent paris having a mutually laterally reversed symmetry with laterally offset isthmuses arrange in a contiguous series forming a serpentine spine running along a central longitudinal axis of said web;

said elongated flaps arranged with proximal edges thereof adjacent said central axis in spaced relation from said axis sufficient to admit a divider insert to be positioned in upright supported relation by and between said proximal edges; and, a pair of generally parallel, laterally spaced apart and longitudinally extending, intermittent fold lines traversing portions of said web that extend laterally between adjacent pairs of said longitudinal array of flaps, defining three panels in said web including two outer panels, and one intermediate panel lying in a horizontal plane;

said flaps being rotate about said hinge line into an upstanding orientation out of said horizontal plane of said web; and, said two outer panels being rotated along said fold lines into a corresponding upstanding orientation in mutually engaged relation with said upstanding flaps, thereby defining a plurality of upright partitions above said horizontal plane of said intermediate panel;

in combination with a divider inset wherein one or more of the flaps and the divider insert are provided with means to enter into mutually engaged relation.

31. The combination according to claim 29 or 30 wherein said carton is a beer carton.

32. The combination according to claim 29 or 30 wherein said combination defines twenty-four separate compartments adapted to receive primary packaging therein.

33. The combination according to claim 29 or 30 wherein said combination is a beer carton adapted to accommodate twenty-four beer bottles arranged in an array comprising four bottles abreast, and six bottles deep, in substantially mutually separated relation within corresponding ones of subcompartments defined by said combination.

* * * * *